United States Patent [19]

Milisavljevic

[11] Patent Number: 4,658,629

[45] Date of Patent: Apr. 21, 1987

[54] HYDRAULIC, PNEUMATIC, PNEUMATIC-HYDRAULIC OR COMBINED PNEUMATIC-EXPLOSION PRESS

[75] Inventor: Milorad S. Milisavljevic, Lucerne, Switzerland

[73] Assignee: PTP Patentierte Technologische Prozesse AG, Lucerne, Switzerland

[21] Appl. No.: 770,864

[22] PCT Filed: Dec. 14, 1983

[86] PCT No.: PCT/CH83/00141

§ 371 Date: Aug. 19, 1985

§ 102(e) Date: Aug. 19, 1985

[87] PCT Pub. No.: WO84/02492

PCT Pub. Date: Jul. 5, 1984

[30] Foreign Application Priority Data

Dec. 20, 1982 [CH] Switzerland ..... 7400/82

[51] Int. Cl.[4] ..... B21J 9/18

[52] U.S. Cl. ..... 72/453.02; 72/453.07; 72/454; 72/430; 72/706

[58] Field of Search ..... 72/454, 453.07, 453.02, 72/453.03, 453.04, 430, 706

[56] References Cited

U.S. PATENT DOCUMENTS

| | | | |
|---|---|---|---|
| 3,320,740 | 5/1967 | Hamkins | 60/26.1 |
| 3,654,799 | 4/1972 | Dischler | 72/454 |
| 4,166,375 | 9/1979 | Stepantsov | 72/430 |
| 4,442,694 | 4/1984 | Fusser et al. | 72/453.07 |

FOREIGN PATENT DOCUMENTS

| | | | |
|---|---|---|---|
| 1099682 | 9/1955 | France . | |
| 2287605 | 5/1976 | France . | |
| 2404492 | 4/1979 | France . | |
| 2470675 | 12/1981 | France . | |
| 461778 | 2/1975 | U.S.S.R. | 72/453.07 |

*Primary Examiner*—R. L. Spruill
*Assistant Examiner*—David B. Jones
*Attorney, Agent, or Firm*—Karl F. Ross; Herbert Dubno

[57] ABSTRACT

Press for manufacturing molded or pressed products, comprising a press tool fixed at one end of a moving cylinder. Said moving cylinder is coaxially mounted inside a fixed guiding cylinder fixed and coaxially suspended inside a cylinder forming the outer envelope of the press. The press has a moving wall defining a first variable volume chamber, eight hydraulic jacks with free differential pistons arranged in crown about the central cylinder. The outer envelope comprises a widening provided with at least a bore wherein are arranged explosion means to cause the displacement of the press tool when the press is used as a combined pneumatic/explosion press. The press has reduced overall dimensions, and may be adapted to the manufacture of different articles at various working rates by simple and fast modifications.

24 Claims, 6 Drawing Figures

HYDRAULIC, PNEUMATIC, PNEUMATIC-HYDRAULIC OR COMBINED PNEUMATIC-EXPLOSION PRESS

CROSS REFERENCE TO RELATED APPLICATIONS

This application is a National Phase corresponding to PCT/CH83/00141 filed Dec. 14, 1983 and based upon Swiss National Application 7400/82-4 of Dec. 20, 1982.

FIELD OF THE INVENTION

This invention concerns a press which particularly is used for the manufacture of products formed by compacting, sintering, pressing, with the aid of a mold or by forging, molding surface pressing, or the like.

More specifically this invention relates to a press which is versatile to be used as a hydraulic press, as a pneumatic press, as a hydraulic-pneumatic press or as a combined hydraulic-explosion press.

BACKGROUND OF THE INVENTION

Numerous hydraulic, pneumatic presses are already known. However, these presses are generally very space consuming. Furthermore it is necessary to provide a comparatively expensive and complicated device for the programming of these pneumatic or hydraulic presses, if during the manufacture of the product various pressures are desired in succession.

Regarding the use of an explosion press for the finishing of metallic products it may, for instance, be noted that these are only mentioned in the book "Meyers Handbuch uber die Technik" ("Meyers Handbook of Technology") published by Bibliographisches Institute Mannheim (page 286).

It seems that the main problem of using the press as an explosion press for the manufacture of pressed, molded, or forged products is the exact dosing of the quantity of the explosive material or the explosion power necessary to perform a given degree of work within a short and regular time interval.

OBJECT OF THE INVENTION

The principal object of this invention is to provide a press which may be used as a hydraulic press, as a pneumatic press, as a hydraulic-pneumatic press, or as a combined pneumatic-explosion press, which occupies little space and which has an operating cycle which may be very simply automated. Furthermore with the press according to the invention, various pressure heads can be achieved during one operating cycle thanks to a positive control of the pressure exerted on the pressing tool.

These objects are achieved with a press which is particularly used for the manufacture of products formed with and of a mold by compacting, sintering or pressing, or which serves for the manufacture of, for instance, metallic products formed by molding, forging, surface pressing, or the like, and which has a pressing tool fixed at the end of a moveable cylinder and a device to move this cylinder, and to exert a predetermined pressure on this cylinder and the pressing tool. According to the invention the elements for moving and applying power to the pressing tool are hydraulic, pneumatic, hydraulic-pneumatic or combined pneumatic-explosion elements.

According to another feature of the invention the moveable cylinder of the press is coaxially positioned inside a fixed guiding cylinder, which is coaxially fixed by suspension inside a cylinder forming an outer wall of the press, whereby this fixed guiding cylinder and the outer-wall cylinder are carried by a supporting platform of the press with their respective upper flange ends.

According to another feature of the invention, the central moveable cylinder of the press has a constriction on which rests a moveable separating wall with an outer cylindrical part which slides sealingly along the inner wall of the outer cylinder in order to form a first chamber of changeable volume filled with a hydraulic medium. The hydraulic elements for the press can comprise a large number of hydraulic cylinders which are crown-shaped and positioned around the central moveable cylinder in the first chamber of changeable volume and the moveable separating wall. Each of these hydraulic cylinders has a free differential piston defining an upper and a lower chamber, whereby the upper chamber of each hydraulic cylinder is fed with a hydraulic pressing element by a pump, and whereby the lower chamber is connected with the first chamber of moveable volume regarding the element.

The hydraulic pressure feeding pump feeds the angularly equispaced hydraulic cylinders.

According to another feature of the invention, each hydraulic cylinder has an extension or an elongation of a reduced cross section, into which scalingly slides the bar of the free piston of this hydraulic cylinder. This elongation of a reduced inner cross section ends above the pressing tools in order to form a second chamber of a changeable volume, filled with a hydraulic medium, with the end of the compressing tool for piston rings.

According to another feature of the invention, the press has an intermediate cylinder positioned around the hydraulic cylinders, and in a coaxial manner inside the outer-wall cylinder, whereby this intermediate cylinder is fixed with its upper broadening or flange on the supporting platform of the press, and forms a ring-shaped chamber containing a coolant with the cylinder forming the outer wall, whereby the cylindrical part of the moveable wall slides in the inner space of this intermediate cylinder.

According to further feature of the invention, the cylinder forming the outer wall of the press has a flange which also extends into the inside of the cylinder, in order to form a container for a cooling medium, such as water. The intermediate cylinder has a shoulder on this flange and a cylindrical part of a smaller cross section, which is in contact with the part of the hydraulic cylinder forming the elongation or the extension, in order to form in this manner a third chamber of a changeable volume. This third chamber of a changeable volume has an upper chamber formed by the moveable wall, the intermediate cylinder and the contraction of this cylinder, as well as a lower chamber connected with the upper chamber by openings in the constriction of the intermediate cylinder, whereby this lower chamber is formed by the flange of the cylinder forming the outer wall, the part of a less cross section of the intermediate cylinder and the pressing tool. Advantageously this pressing tool has an upper cylindrical part which slidingly protrudes into the space between the inner wall of the broadening of the outer cylinder and the part of reduced cross section of the intermediate cylinder.

Furthermore the pressure feeding pump for the hydraulic cylinder has a piston which is fixed on the upper end of the upper part of reduced cross section of the moveable central cylinder of the press and is, for instance, operated by a screw or spindle press.

According to another feature of the invention, the press has a piston provided with a packing, which is slidingly positioned in the central moveable cylinder of the press beneath its constriction, and which has a piston rod which is positioned inside the upper part of the reduced cross section of this cylinder, and the cylinder tightly connected with the piston of the pressure feeding pump. Operating devices for this piston are connected with the upper part of the piston rod in order to effect the movement of this rod and of the piston in the central moveable cylinder; the operating device can advantageously be formed by a screw press positioned on the screw press for the operation of the pressure feeding pump.

According to another feature of the invention, in case of the use as a press of a combined pneumatic-explosion press, the explosion elements have at least one cylinder formed by a bore in a broadened part of the region forming the outer cylinder of the press, whereby this cylinder is provided with a pipe lining in which a cylinder sealingly slides and which is tightly connected with the pressing tool and which forms an overhang protruding above the upper area of a ring-shaped part of this pressing tool. Devices are provided for the ignition and fuel feeding to the cylinder. A compressed air feeding device is provided for each cylinder and, finally, an exhaust pipe is formed on the upper part of the cylinder of this explosion element in the broadening of the cylinder forming the outer wall of the press.

The valve faces for the block of the inlet valve, and the block of the outlet valve are positioned at the upper end of the piston and at the upper region of the cylinder of the explosion elements. Advantageously the inlet valve has a longitudinal bore in which coaxially and slidingly the body of the outlet valve of the cylinder is positioned. The shaft of this outlet valve passes the ring-shaped part of the pressing tool, and has a stop motion device on that part which protrudes the pressing tool in order to effect the opening of the outlet valve after the passing of a predetermined stroke of the pressing tool, thus limiting the stroke of this pressing tool.

Furthermore the compressed air feeding pump for each cylinder is formed with a fresh air inlet valve provided in an opening at the bottom of the central moveable cylinder of the press, whereby the chamber of the central moveable cylinder is connected with the chamber of the piston by an air feeding pipe.

Furthermore the pressing tool has a driving piston fixed on the end of the central moveable cylinder, on which exchangeable pressing tools are fixed which correspond to the form of the product to be manufactured.

SPECIFIC DESCRIPTION

Figure 1:
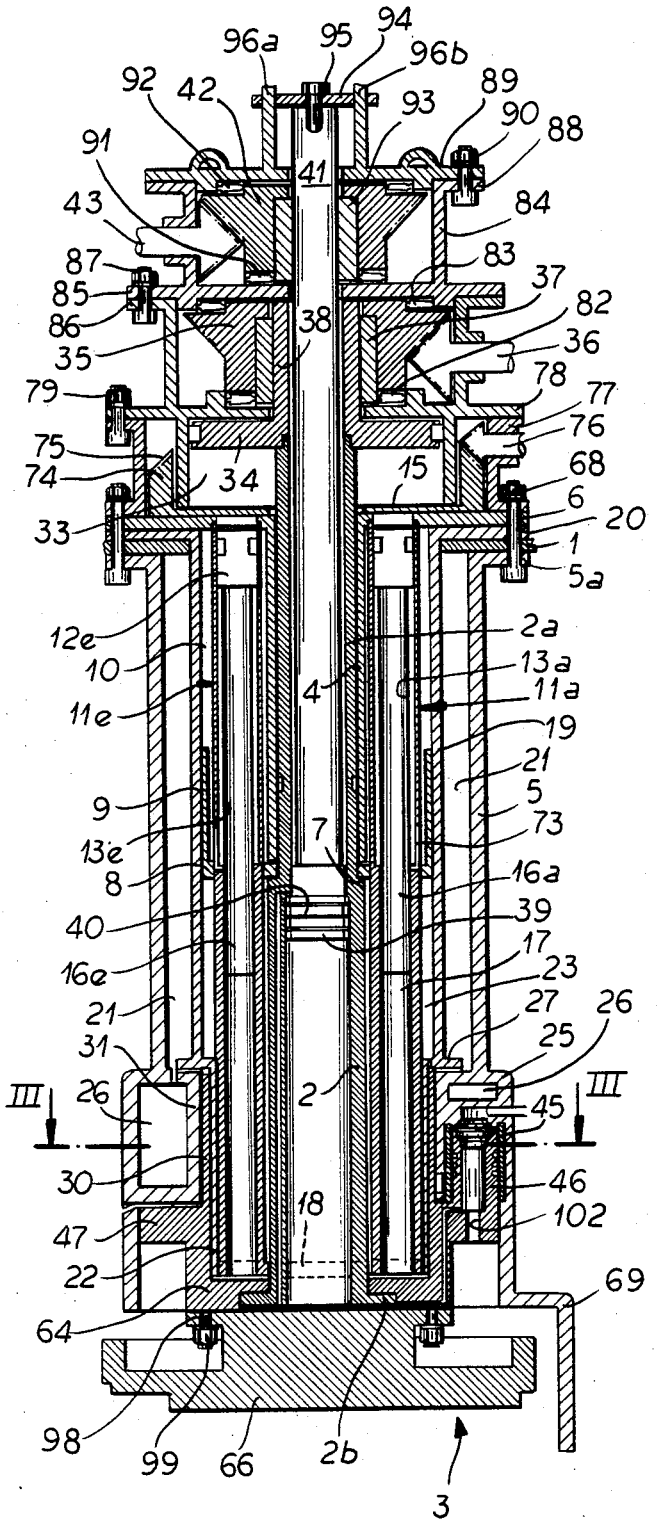
FIG. 1 is an axial section view of the press according to the invention, used as a hydraulic press with the pressing tool located at its upper dead point.
Figure 2:
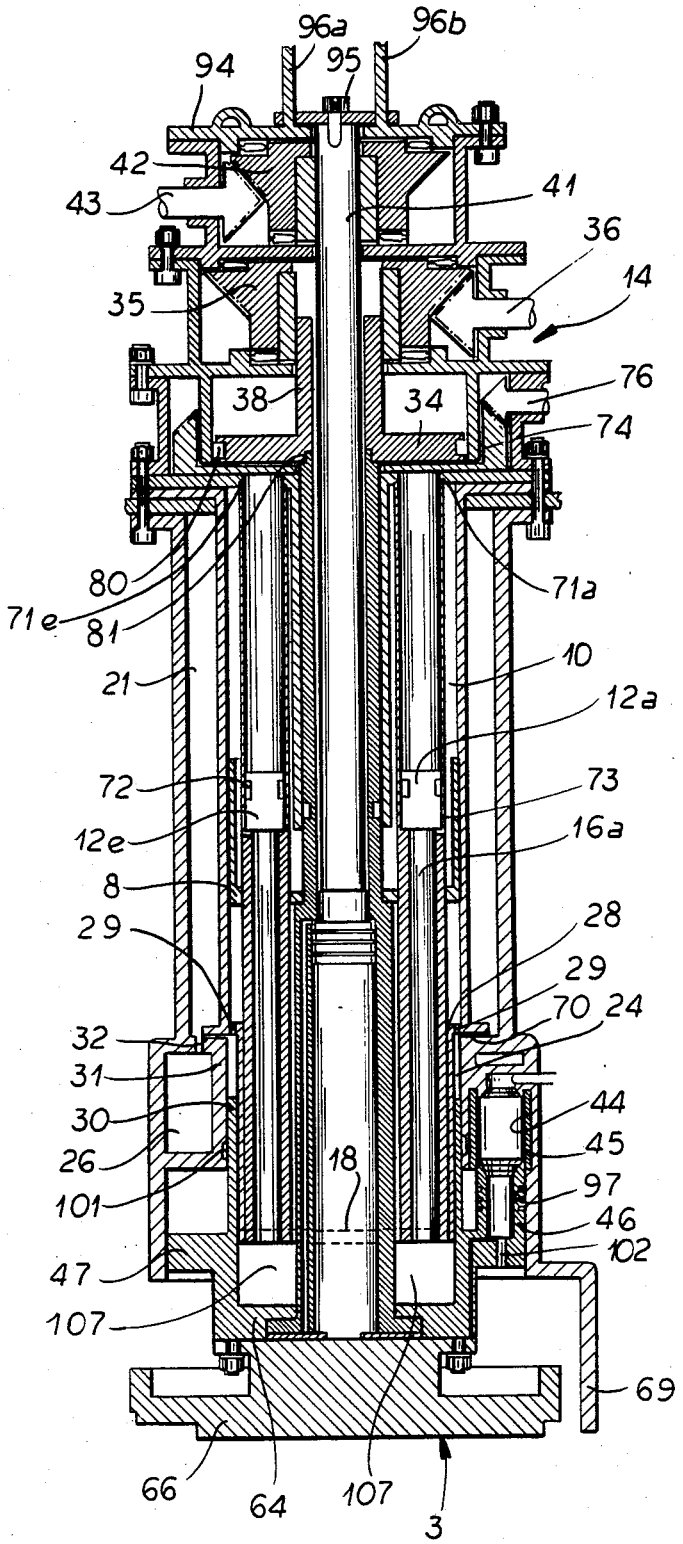
FIG. 2 is a view corresponding to FIG. 1 in which the pressing tool is situated at its lower dead point.

The press according to invention, illustrated in its totality in FIGS. 1 and 2, is positioned on a support by a platform 1. This press may be used individually or combined with other devices which allow a product to be placed below the pressing tool 3 in a mold to manufacture molded products by sintering, pressing, or the like. The molds can be transported in succession by a carousel beneath the pressing tool and guarantee a continuous manufacture of articles. As will be described below, the operating cycle of the press according to the invention, can easily be automated, and according to the working cycle, a cycle for the manufacture of molded products can be programmed.

The press according to invention, may either operate as a hydraulic press, as a pneumatic press or as a hydraulic pneumatic press, or as a combined hydraulic-explosion press according to the products to be manufactured.

In the following, the various operating modes as well as their elements are described in succession.

Figure 3:
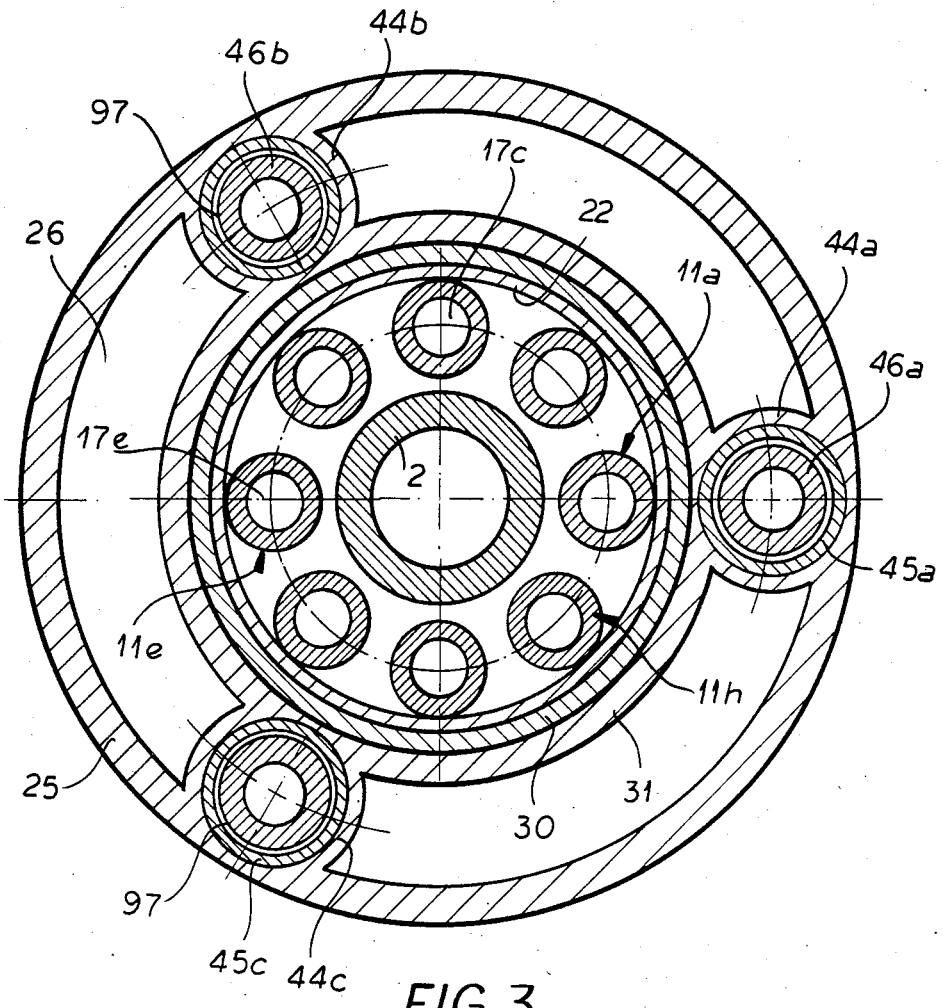
FIG. 3 is a cross sectional view along the line III—III of FIG. 1.

With reference to FIGS. 1 to 3 the press according to invention, and in particular a first embodiment of this press is described; this press may operate as a hydraulic, pneumatic or hydraulic-pneumatic press.

This press has an outer cylinder 5 forming the wall of the press and which is fixed by suspension at an upper flange 5*a* on the platform 1 by nuts 68.

The press according to the invention, has also a moveable central cylinder 2, which is slidingly positioned inside a fixed guiding cylinder 4, coaxially positioned in the inside of a cylinder 5, and fixed with its upper flange 6 on the platform 1 with the help of nuts 68. At the lower end of the moveable central cylinder 2 the driving piston 64 of the pressing tool 3 is tightly fixed at a flange 2*b* of cylinder 2.

This press has also an intermediate cylinder 19 coaxially positioned on the cylinders 5, 4 and 2, and fixed with its upper flange 20 on the platform 1 with the help of nuts 68.

The cylinder 5 forming the outer wall, has a first flange 25, which also extends into the interior of the cylinder in order to form a ring-shaped container 26 for a cooling medium, such as water. This container has an inner wall 31 provided with a packing 101 in order to guarantee a sealing sliding of a cylindrical inner part of the driving piston 64 of the press on the inner area of the wall 1. Advantageously the outer wall of the container 26 has a feeding pipe for the cooling liquid (not illustrated).

In the illustrated embodiment, the cylinder 5 of the press has a second, lower flange 69 in order, for instance, to allow the placing of a container for a material mixture to be pressed (not illustrated).

The intermediate cylinder 19 has a shoulder 27 and a contraction 28, supported by the flange of the outer wall cylinder 5 with the help of a packing.

The intermediate cylinder 19 consequently defines with cylinder 5 a ring-shaped chamber containing a coolant like water, and connected by the passage 32 in the broadening 25 of the outer cylinder 5. Furthermore the lower part 22 of reduced cross section of the intermediate cylinder 19 is in contact with the inner part of the driving piston 64 of the pressing tool 3 above its total height, and in a sliding manner, and in particular with the inner area of the cylindrical part 30 of this driving piston.

Furthermore the press according to invention, has eight hydraulic cylinders 11*a* to 11*h* which are positioned in a crown pattern around the moveable central cylinder 2 and the guiding cylinder 4. The hydraulic cylinders are positioned by suspension with their upper ends in nuts 71*a* to 71*h* of openings in the broadening 6 of the guiding cylinder 4. Furthermore these hydraulic cylinders 11*a* to 11*h* are kept in their position by a fixed lower plate 18 which is welded at the lower end of the contracted part 22 of the intermediate cylinder 19, and has openings for the lower ends of the cylinders of each hydraulic cylinders 11*a* to 11*h*.

Each hydraulic cylinder 11*a*–11*h* has a free differential piston 12 provided with packings 72 and a piston rod 16*a*–16*h* which in a sealing manner slides in the lower elongation area of each hydraulic cylinder with an inner cross section which mainly corresponds to the cross section of the piston rod 16. The piston 12 defines at its lower end a cylindrical chamber 13 of changeable volume above the moveable plate 8 between the intermediate cylinder 19 and the guiding cylinder 4. This connection is made by openings 73 which, for instance, have a rectangular cross section and which are formed in the lower area of the cylinder chamber 13 of each hydraulic cylinder 11 underneath the packing 72 of the free differential piston 12, when these are at their lower dead point.

The press has a second chamber of changeable volume 17, 107 which is defined in the broadening part of each hydraulic cylinder 11*a*–11*h* by the lower end of the piston rods 16*a*–16*h* as well as of the fixed plate 18. This second chamber of changeable volume has the upper part of the driving piston 64 of the pressing tool as its bottom.

The press according to invention, has also a third chamber of changeable volume divided into two chambers, namely an upper chamber 23 underneath the moveable plate 8 between the moveable cylinder 2 and the intermediate cylinder 19, and a second chamber 24 beneath the constriction 28 of the intermediate cylinder 19 and between its lower contracted part 22 and the inner wall 31 of the cooling liquid container 26. The two chambers 24, 23 for the cooling liwuid are connected by an opening 29, in the contracted part 28 of the intermediate cylinder 19 and which consequently forms the third chamber of changeable volume of the press according to invention.

The press has also a central piston 39, provided with packing rings 40 which are slidingly arranged in the lower part of the central moveable cylinder 2. This central piston has a piston rod 41 which is slidingly positioned in the inside of the upper part 2*a* of a reduced cross section of the central cylinder.

In this embodiment the press has a pump 14 for the feeding of a hydraulic element under pressure into the hydraulic cylinders 11*a*–11*h* with the help of an oil distributor which is formed by a plate 15 in the upper broadening 6 of the guiding cylinder 4 and which has a single opening in order to consecutively divide the hydraulic medium fed under pressure by the pump 14 to each hydraulic cylinder 11*a*–11*h*. This plate has a cylindrical part 74 provided with teeth engaging the teeth of a driving wheel 76, carried by an outer cylinder 77 which, with its lower flange, is fixed at the platform 1 and carries by its upper broadening a case 78 of the feeding pump 14 fixed by nuts 79.

The oil pressure feeding pump 14 has a piston 34 provided with a packing 80 which in a sealing manner is slidingly arranged in the inside of the case 78 in order to form a pressure element chamber 33. The piston 34 is supported on its lower part by a constriction 81 of the upper part of the central moveable cylinder 2.

The piston 34 of the oil pressure feeding pump 14 is operated by a lower screw press which is included in the case 78 and a pinion 35, which is in contact with a driving wheel 36 and has a screw nut 37 designed for the upward movement, which is inserted and fixed in a central bore of the pinion 35. This screw nut 37 is in contact with a thread shaft 38 tightly fixed on the piston 34.

The pinion 35 is carried by lower and upper roller bearings 82, 83.

It is, of course, possible to replace the lower screw press to operate the feeding pump 14 by another suitable guiding device.

In the preferred embodiment of the invention, the press can have an upper screw press included in an upper case 84 which is fixed with its lower flange 85 at the upper flange 86 of the case 78 by nuts 87. This case 84 carries with its upper flange 88 a cover 89, which is fixed by nuts 90. The upper screw press has a pinion 42 carried by lower and upper roller bearings 91, 92 in contact with a driving gear 43; a screw nut 93 designed for the upward movement is fixed in a central boring of the tooth wheel 42, which is in contact with a threaded part of the shaft 41 of the central piston 39 of the press. This piston rod 41 traverses the cover 89 and is kept by a guiding yoke 94 with the help of a nut 95, so that it cannot rotate. This yoke is positioned on at least two guiding slide rails 96*a*, 96*b* tightly fixed to the cover 89. Finally the pressing tool 3 has the driving piston 64, positioned on the central moveable piston 2 of the press by a central opening, with a ring-shaped area 47 at the upper part of which at least one cylinder 46 is fixed forming a piston, the outer area of which is provided with packing rings 97 and slidingly positioned in the inside of a pipe 45 in a boring 44, which forms a cylinder in the lower part of the broadening 25 of the moveable outer cylinder 5.

The pressing tool furthermore has a degradable tool plunger 66 fixed on the driving piston 64 by bolts 98 and nuts 99. The tool plunger 66 has a form conforming with that of the mold of the products to be manufactured.

The press as described above may operate as a hydraulic press, whereby the elements forming the hydraulic press are formed by the feeding pump 14 for the pressure medium like oil, by the hydraulic cylinders 11*a*–11*h*, the first chamber of changeable volume 10, 13, the second chamber of changeable volume 17, 107 and by the third chamber of changeable volume formed by the two chambers 23, 24. The operation of the hydraulic is as follows:

The lower screw press is operated in order to set under pressure the pressure medium or oil contained in the container or in the chamber 33.

The distributor or bottom 15 is set into rotation in order to successively feed the hydraulic medium into the hydraulic cylinder 11*a*–11*h* thus effecting the downward movement of the free piston 12*a*–12*h*. Advantageously the volume of the container 33 is basically equal to the sum of the volume of each hydraulic cylinder 11*a*–11*h* with the pistons 12*a*–12*h* being at their low dead point. The downward movement of the piston 34 of the hydraulic feeding pump 14 effects a movement of the central cylinder 2 on account of the mechanical power exerted by the piston 34 on the shoulder 81 of the cylinder 2.

The downward movement of the pistons 12*a*–12*h* in the hydraulic cylinder 11*a*–11*h* pushes the liquid contained in the cylindrical chamber 13 by openings 73 into the chambers of changeable volume. The pressure increase of the medium contained in this chamber 10 effects the movement of the moveable plate 8 which consequently exerts a power on the central piston 2 at the height of its shoulder or flange 7 and thus on the pressing tool 3.

The downward movement of the pistons 12*a*–12*h* at the same time effects the downward movement of the piston rod 16*a*–16hin the chamber of changeable volume 17, 107, and consequently causes an increase of the pressure of the hydraulic medium contained in this chamber, and exerts a new pressure on the surface of the driving piston 64 of the pressing tool 3.

Finally the downward movement of the moveable wall 8 effects a pressure increase in the chamber of changeable volume 23 and forces the hydraulic medium contained in this chamber to pass through the openings 29*a*, 29*b* into the lower chamber in order to exert another pressure on the cylindrical part 30 of the driving piston 64 and thus on the pressing tool 3.

The power of the hydraulic medium exerted consecutively on the head of each differential piston 12*a*–12*h*, is adjustable by adjusting the pressure produced by the hydraulic pump 14 during the whole downward movement of the central moveable cylinder 2 and thus of the pressing tool 3.

As the differential pistons are moving downwards one after another, the power of the pressure in the first chamber of changeable volume 10 is determined in a functional relation between the active surface of the differential piston of each hydraulic cylinder and the active surface of the wall 8 as well as by the power exerted by the piston 34 of the feeding pump 14.

Furthermore the volume of the intermediate chamber 23 with the moveable separation wall 8 at its upper dead point is equal to the volume of the lower chamber 24, with the driving piston 64 being at its lower dead point. The power of the pressure exerted by the hydraulic media in these chambers 23 and 24 is equal to the power of the pressure which has already been transmitted by the moveable plate 8 to the driving piston 64 with the help of the flange or shoulder 7 of the moveable central cylinder 2.

Finally the volume of the chamber of changeable volume 107 is equal to the volume of the chambers 17*a*–17*h* of the extensions of the hydraulic cylinders 11*a*–11*h* when the driving piston 64 of the pressing tool is at its lower dead point.

During the seccessive downward movements of the differential pistons 12*a*–12*h*, the power exerted by the oil in chambers 17 and the chamber of changeable volume 107 on the driving piston 64 of the pressing tool, is equal to the pressure originating from the relation between the surface of a single piston rod 16*a*–16*h* and the upper active surface of the bottom of the driving piston of the pressing tool, and depends on the power produced by the oil feeding pump at the given time.

FIG. 2 shows the position of the various elements of the press with the pressing tool at its lower dead point.

The return of the pressing tool from its upper dead point is effected by operating the lower screw press in order to push back the piston 34 of the feeding pump 14 to its upper dead point and consequently to cause the upward movement of the differential pistons 12*a*–12*h* and of the driving piston 64 to the upper dead point in a synchronous manner with the upward movement of the piston rod 41 and of the central piston 39 with the help of the upper screw press, and by the synchronized rotation of the hydraulic distributor bottom 15. This central piston 39 always remains in its protected position on the lower part of the constriction of the moveable central cylinder 2. For this purpose the thread shaft 41 of the upper screw press or the piston rod is decoupled during the downward movement of the pressing tool, and again coupled for the upward movement of this pressing tool to its upper dead point.

In such a press the packing devices are only provided for the elements such as the central piston 39, the differential pistons 12*a*–12*h*, the inner wall 31 of the flange 25 of the outer cylinder 5.

With this press according to invention, it is not necessary to provide packing elements between the various chambers of changeable volume 11, 13, 23, 24, 17, 107, as the surfaces of the pistons and the moveable separating wall are calculated in such a way that their relation in all chambers 10, 13, 17, 23, 24, 107 containing a hydraulic with a mainly equal pressure, is identical.

Consequently these containers themselves may be connected with each other by small pressure compensation openings which in no way influence the effectiveness of the press. Furthermore these compensation openings allow a cut-off of possible differences in volume of the various chambers originating from faults of fabrication. These compensation openings therefore allow a filling of the chambers of changeable volume with a hydraulic medium by a single hydraulic admission opening and particularly a compensation of possible leakages of the hydraulic medium.

Consequently the press has the following advantages:

it is able to produce large pressing forces while occupying a small space;

the final pressure exerted by the driving piston of the pressing tool is equal to the sum of the various pressures produced in each chamber of changeable volume, and results from a multiplication of the pressure exerted by the piston 34 of the hydraulic feeding pump 14;

a significant saving of energy;

a large stroke of the pressing tool compared with the height of the press, and consequently an important capacity to feed a mixture into the molds as well as a pressing power which is adjustable up to the complete pressing or stamping of the parts to be pressed;

this press may be used as a hydraulic press with a very soft operating manner, which may easily be automated by programming the pressure exerted by the piston 34 of the hydraulic feeding pump 14, as a hydraulic, pneumatic press or hydraulic-pneumatic press or as a combined explosion press as will be described.

It is also very simple to replace the pressing tool and the devices to adjust the pressure and the working cycle of such a press are easily accessible.

Therefore the press is easily adaptable in function of the working cycle desired for the manufacture of a special product. This adaptation can, for instance, be effected by:

adjustment of the stroke of the pressing tool, adjustment of the starting point, exchange of the tool piston, or adjustment of the speed of the downward movement and the return movement of the pressing tool.

Figure 4:
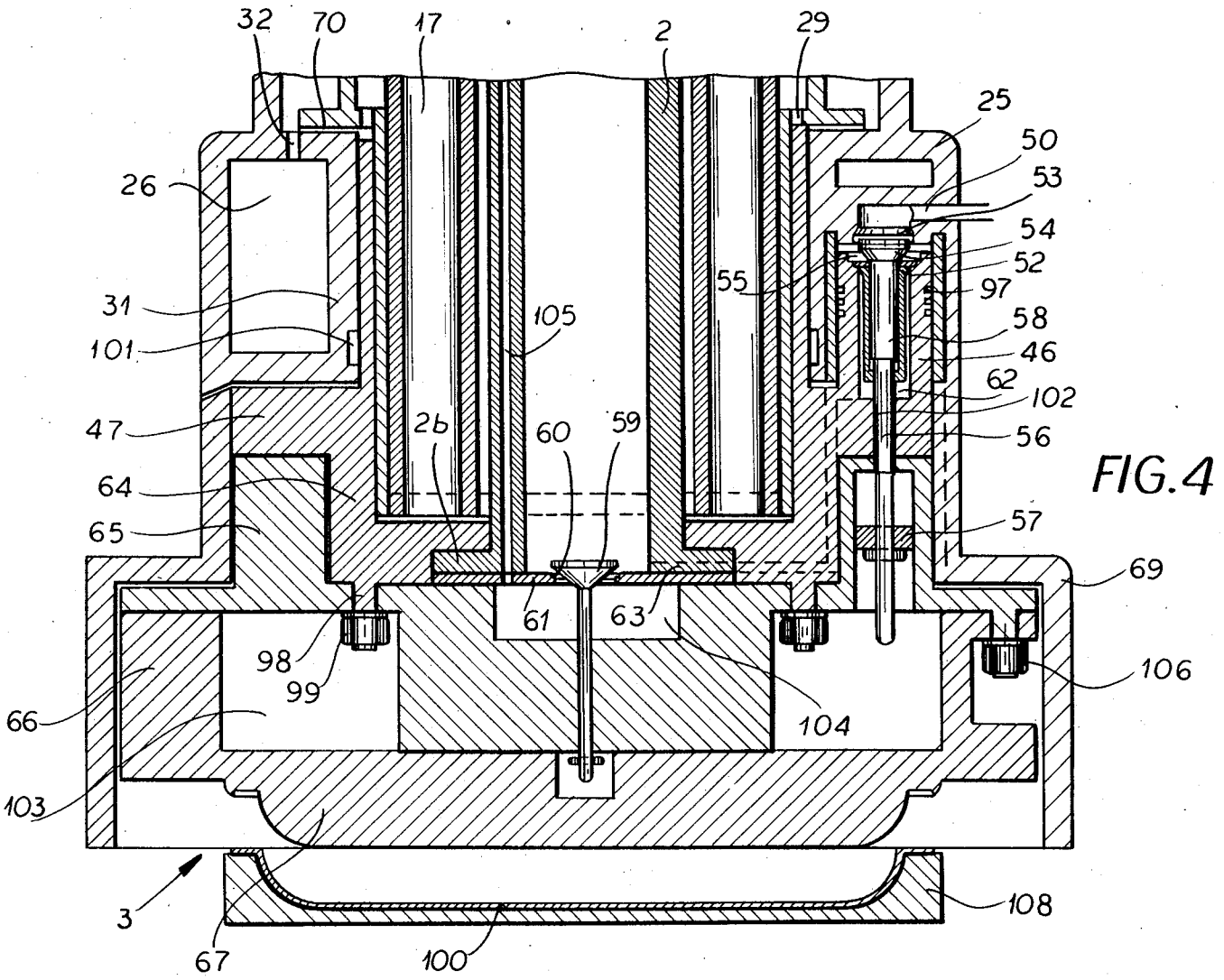
FIGS. 4, 5 and 6 are axial section views of the lower part of the press according to invention operating as an explosion press and show various manufacture phases of a pressed product at the beginning, during and at the end of the manufacture of this product.
Figure 5:
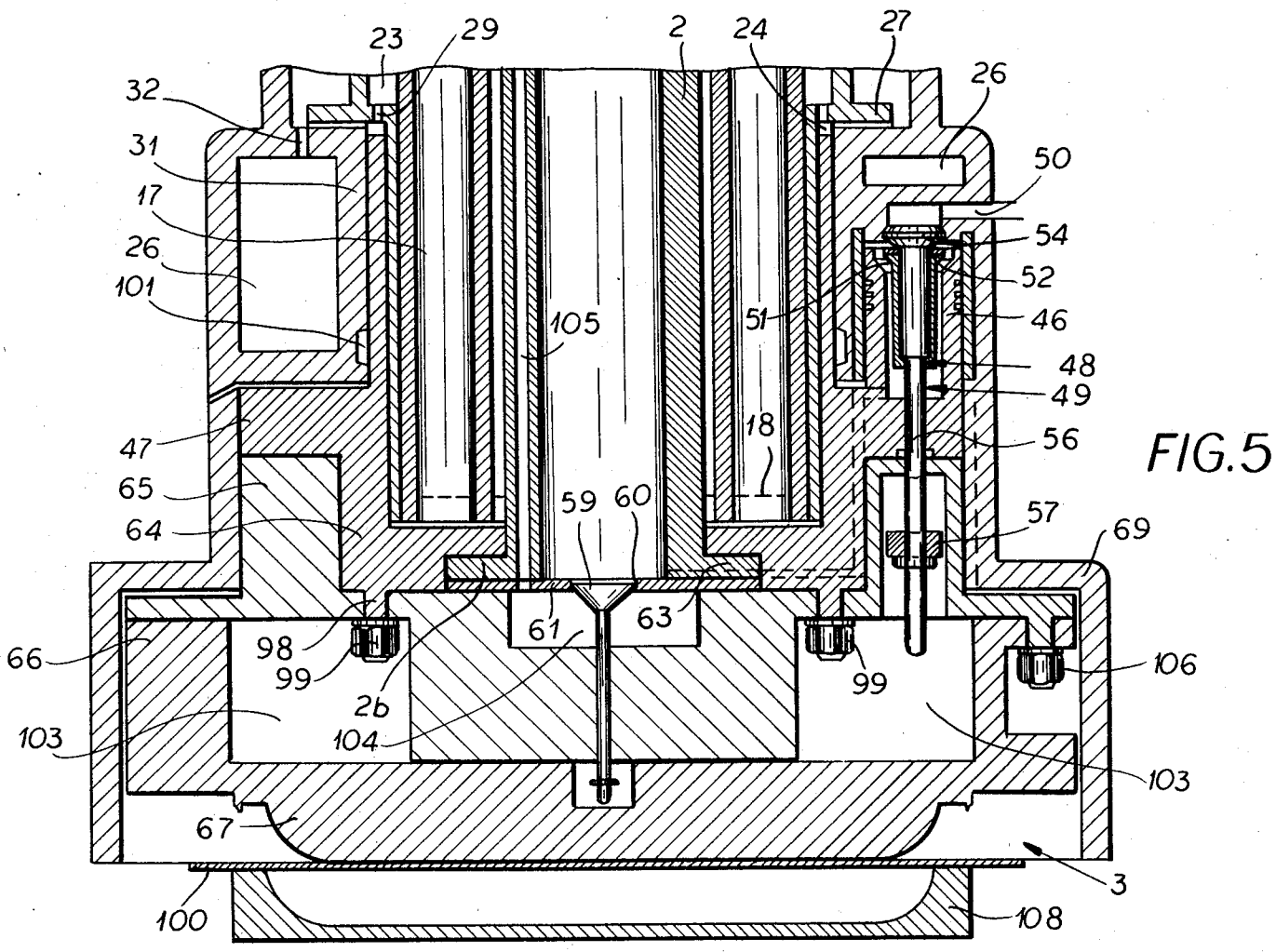
Figure 6:
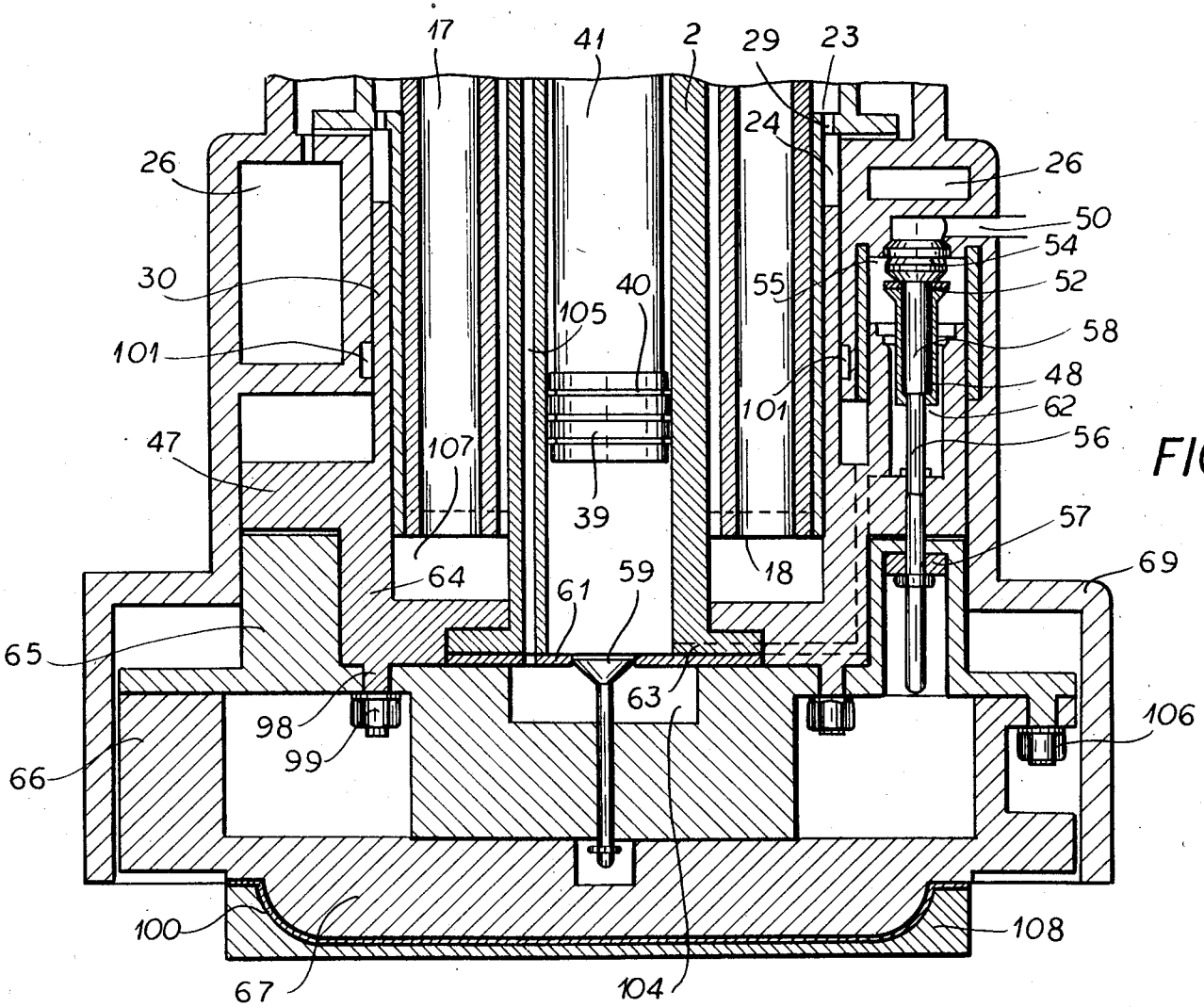

FIGS. 4, 5 and 6 shown an embodiment in the form of an explosion press, particularly for the manufacture by stamping of metallic products such as metal sheet 100, which is positioned above a female bottom die 108.

In order to convert the previously described press into an explosion press, the pistons 46 tightly connected with the ring 47 of the driving piston 64 are provided with two valves, namely an inlet valve 48 and a discharge valve 49. A valve face 51 is developed at the the upper end of the piston 46, in order to receive the block 52 of the inlet valve 48. Another valve face 53 is provided in the discharging end of a discharge pipe 50 in order to take up the block 54 of the discharge valve 49.

The inlet valve 48 has an axial central bore in which the body 58 of the discharge valve is slidingly inserted, whereby the shaft 56 of this discharge valve is slidingly positioned in a bore 102 forming a valve stem guide, which is formed in the ring-shaped part 47 of the driving piston 64. Furthermore the end of this valve shaft 56 is provided with a thread, and has a stop element 57, the position of which is adjustable and which is provided underneath the ring-shaped part 47 of the driving piston, in order to effect the opening of the discharge valve, after the pressing tool has covered a certain distance, and by this means to adjust the pressing depth of the stamping caused by this press.

The dense chamber 62 of the piston 46 is connected with the chamber of the moveable central cylinder 2 by a fresh air admission pipe 63 and is in connection with the combustion chamber 55 when the inlet valve is in its opened position. This combustion chamber is defined between the inlet valve 48 and the discharge valve 49 when these are on their respective valve faces.

This combustion chamber is equipped with devices for the fuel injection and ignition. It goes without saying that the press may have a single cylinder 44 or several cylinders, for instance three cylinders **44*a*–44*c* as shown in FIG. 3**.

In this embodiment the tool piston 65 is connected with the driving piston 64, has side accessible borings 103 for receiving the piston rod 56 and the stop elements 57 and a central boring 104 which on one side is connected with the atmosphere, and on the other side by a fresh air inlet valve 59 with the chamber of the central moveable cylinder 2. This fresh air inlet valve 59 has a valve face 60 which is formed in a circular plate 61, fixed underneath the lower broadening **2*b* of the central cylinder 2. The piston shaft of this valve is positioned in a shaft guide bore in the body of the tool piston 65**.

Advantageously in this embodiment the tool piston 65 is formed by the plate 65 which is fixed on the driving piston 64 by boltrs or nuts 98, 99, and by a second part 66 fixed by bolts 106 on the plate 65. This second part has a lower area forming the male forging die 67, in order to effect the stamping of the metallic sheet 100.

The explosion press operates as follows:

The working cycle of such a press is divided into three times:

Inlet of fresh air, compression and explosion exhaust. The fresh air inlet is effected by operation of the upper screw press which permits the central piston 39 in the central moveable cylinder 2 to run up to its upper dead point, and by this means effects the opening of the fresh air inlet valve 59 and the admission of fresh air into the central moveable cylinder 2.

Furthermore the upward movement of the piston 39 and its threaded rod 41 effects an upward movement of the pressing tool 3, and consequently of the pistons **46*a*–46*c* to their respective upper dead points as well as of the inlet and outlet valves 48 and 49. The position of the various mechanical elements during the inlet phase is illustrated in FIG. 4**.

As soon as all mechanical elements of the press have reached their upper dead points, the compression phase begins (FIG. 5) by operating the upper screw press, so that now the downward movement of the central piston 39 in the moveable central cylinder 2 may be effected. The fresh air inlet valve 59 is closed, and the fresh air contained in the cylinder 2 is fed under pressure into the piston chamber 62 by the fresh air feeding pipe 63, which causes the opening of the inlet valve 48 and the closing of the outlet valve 49. The air compressed in the cylinder 2 by the piston 39 thereby is fed into the combustion chamber 55. As soon as the pressure in the combustion chamber reaches a predetermined value, which for instance is to be measured by a manometer (not illustrated), the downward movement of the central piston 39 is automatically stopped. The compression phase is now completed.

The fuel thereafter is injected into the combustion chamber 55 and ignited by the aforementioned injection and ignition devices, which causes the explosion of the gas mixture simultaneously in the three combustion chambers **55*a*–55*c*. This causes the opening of the inlet valves 48 and the transmission of the stroke to the pressing tool with the help of the ring 65, and consequently the stamping of the metal sheet 100**. The composition of the gas mixture contained in the combustion chamber, is dosed as a function of the work to be performed and thus the desired power of pressing and stamping.

After the pressing tool has executed a predetermined stroke, the ring 65 comes into contact with the stop elements 57 positioned on the shaft 56 of the outlet valve 49, which causes its opening. By this means the exhaust gas contained in the combustion chamber 55 may escape by the outlet pipe 50. This position is illustrated in FIG. 6.

Furthermore at this moment the combustion chambers **55*a*–55*c* are scavenged by the compressed air in the central cylinder 2 above its piston 59 and in the fresh air feeding pipes 63. Furthermore the cooling of the piston 39 is guaranteed by admission and backpressure of the fresh air during its alternative movement by a channel 105 connected with the fresh air chamber 104**.

Advantageously the piston 34 of the hydraulic feeding pump 14 is run up under pressure to its upper dead point during the first upward movement of the piston 39, and the piston rod 41, or before using the press as an explosion press, in order to transfer the hydraulic medium contained above the pistons **12*a*–12*h* of the hydraulic cylinder 11*a*–11*h* into the container 33 of the feeding pump, for instance by operating the lower and upper screw press during the fresh air admission into the central cylinder 2. Thereafter the lower screw press and the oil distributing plate 15 are held in order to prevent the passing of the hydraulic medium from the container 33 into the hydraulic cylinder 11*a*–11*h***.

The hydraulic medium which may have remained in the various chambers of changeable volume, and the pistons of the hydraulic cylinder move downwards or rise upwards, depending on the movements of the central moveable cylinder 2 and of the central piston 39 without being exposed to the explosion stroke.

The press according to invention, which may be used as a hydraulic press, if no fuel is injected into the combustion chamber 55 of the cylinders 44*a* and 44*c*, only by setting into motion the lower screw press and the hydraulic distributing plate 15, is converted to the explosion areas by its blocking and the injection of a fuel into the combustion chamber of the cylinders 44*a*–44*c*, which causes the explosion of this fuel fresh air mixture admitted into this chamber.

I claim:

1. A press for the shaping of a material, comprising:

a supporting platform;

an outer fixed cylinder having a flange at an upper end thereof secured to said platform, said outer fixed cylinder depending from said platform and forming an outer wall of the press;

an inner fixed guiding cylinder coaxially received in said outer fixed cylinder with all around clearance and formed with an upper end having a flange secured to said platform;

a cover overlying said upper end of said inner fixed guiding cylinder and secured thereto, said cover having a central opening;

a movable cylinder slidably received in and guided by said inner fixed guiding cylinder and having a lower end lying below a lower end of said inner fixed guiding cylinder, said movable cylinder extending upwardly through said cover;

a pressing tool engageable with said material mounted on said lower end of said movable cylinder;

drive means mounted on said platform above said cover and said flanges for displacing said movable cylinder downwardly an exerting upon said movable cylinder and upon said tool through said movable cylinder a pressing force;

a central piston slidably received in said movable cylinder and entrainable therewith upon displacement for said movable cylinder by said drive means; and retraction means mounted on said platform above said cover and said flanges and adapted to be coupled to said central piston for retracting same and thereby entraining said movable cylinder upwardly.

2. The press defined in claim 1 wherein said lower end of said movable cylinder is formed with a driving piston having a cylindrical part guided in said outer fixed cylinder and a solid ring formed on said cylindrical part, an inwardly extending flange of said driving piston being connected to an outwardly extending flange of said movable cylinder and to said pressing tool.

3. The press defined in claim 2 wherein said driving piston further comprises a ring-shaped part lying below said solid ring and projecting axially upwardly from a plate fixed to said driving piston and formed with an axial downwardly projecting central part bearing on said pressing tool.

4. The press defined in claim 1, further comprising an intermediate cylinder coaxial with said inner and outer cylinders, said lower end of said movable cylinder being formed with a driving piston carrying said pressing tool and slidably guided on an outer surface of said intermediate cylinder, said intermediate cylinder having an upper end formed with a flange fixed to said platform, said intermediate cylinder and said outer cylinder defining between them an annular compartment adapted to receive a coolant, said lower end of said intermediate cylinder being formed with holes, and a plurality of hydraulic cylinders each received in one of said holes and extending axially alongside said movable piston while being fixed to said cover and said intermediate cylinder and having pistons bearing upon said driving piston.

5. The press defined in claim 4 wherein said outer cylinder has a lower end formed with an enlargement defining a coolant-containing compartment, said intermediate cylinder having an outwardly extending shoulder resting on said enlargement.

6. The press defined in claim 4 wherein said movable cylinder is formed with a shoulder on its exterior defining in said intermediate cylinder a variable-volume chamber closed at an upper end thereof by said cover and communicating with the interiors of said hydraulic cylinders, said hydraulic cylinders being provided with formations engageable with the pistons thereof at the level of said shoulder of said movable cylinder.

7. The press defined in claim 6 wherein drive means includes a hydraulic pump having a pump chamber communicating with said hydraulic cylinders.

8. The press defined in claim 7 wherein said pump is provided with distributor means successively communicating said hydraulic cylinders individually with said pump.

9. The press defined in claim 8 wherein said pump has a pump chamber closed at a bottom side thereof by a rotatable bottom member forming said distributor and having a single opening successively registerable with said hydraulic cylinders.

10. The press defined in claim 6 wherein each of said hydraulic cylinders has a reduced cross section at a lower portion thereof in which a respective rod of the respective piston in the hydraulic cylinder slides, said piston rods defining at their lower ends with said driving piston a variable-volume chamber filled with hydraulic fluid.

11. The press defined in claim 6 wherein said driving piston has a cylindrical portion defining between said intermediate and outer cylinders an annular chamber communicating by openings with the interiors of said intermediate and outer cylinders.

12. The press defined in claim 6 wherein said drive means includes a pump for feeding a hydraulic medium into said hydraulic cylinders under pressure, said pump comprising a pump chamber located above said cover and a pump piston fixed on an upper end of said movable cylinder for displacing said medium from said pump chamber.

13. The press defined in claim 12 wherein said pump piston is formed with a screw engageable by a nut having a configuration of a driving gear and meshing with a driving pinion.

14. The press defined in claim 6 wherein the volume of said pump chamber is substantially equal to the sum of the volumes of said hydraulic cylinders when the piston thereof are located at their lowermost positions.

15. The press defined in claim 12 wherein said retraction means includes a thread on said central piston, a nut engaging said thread and formed with a gear and a drive pinion meshing with said gear.

16. The press defined in claim 15 wherein said drive piston is provided with means disposed above said retraction means for preventing retention of said central piston.

17. The press defined in claim 1 wherein said outer cylinder is formed at a lower end thereof with at least one bore adapted to receive an explosive composition for applying explosive force to said tool.

18. The press defined in claim 17 wherein a driving piston is provided to connect said tool to said movable cylinder, said driving piston being formed with a piston formation engageable in said bore, means being provided for feeding said bore with fuel and compressed air for igniting a fuel-air mixture in said bore.

19. The press defined in claim 18 wherein a plurality of such bores and piston formations are provided and said lower end of said outer cylinder is provided with a coolant chamber common to all of said bores and said piston formations.

20. The press defined in claim 18 wherein said piston formation is provided with an exhaust valve.

21. The press defined in claim 20 wherein said exhaust valve is provided with a rod adapted to actuate said valve after a predetermined stroke of said tool.

22. The press defined in claim 21 wherein said piston formation is provided with an inlet valve having a longitudinal bore in which said outlet valve is slidably and coaxially positioned.

23. The press defined in claim 19, further comprising an inlet valve for feeding air to said bore and provided centrally at the bottom of said movable cylinder.

24. The press defined in claim 4 wherein each of said hydraulic cylinders has a region of reduced cross section in which a rod of a respective piston sealingly slides, said regions of reduced cross section terminating above the pressing tool to form a chamber of changeable volume at the end of the respective piston rod which is filled with a hydraulic fluid.

* * * * *